US005771854A

United States Patent [19]

Barton

[11] Patent Number: 5,771,854

[45] Date of Patent: Jun. 30, 1998

[54] OIL PUMP ADAPTOR

[75] Inventor: Raymond A. Barton, Wernersville, Pa.

[73] Assignee: Ray Barton Racing Engines, Inc., Wernersville, Pa.

[21] Appl. No.: 779,399

[22] Filed: Jan. 7, 1997

[51] Int. Cl.[6] ..... F01M 1/02

[52] U.S. Cl. ..... 123/196 R; 123/198 C

[58] Field of Search ..... 123/196 R, 198 C, 123/196 A, 196 AB

[56] References Cited

U.S. PATENT DOCUMENTS

| | | | |
|---|---|---|---|
| 3,384,063 | 5/1968 | Moulton et al. | 123/198 C |
| 3,777,847 | 12/1973 | Lawless | 123/196 R |
| 4,086,012 | 4/1978 | Buckley et al. | 403/2 |
| 4,121,532 | 10/1978 | Coryell, III | 115/34 R |
| 4,373,483 | 2/1983 | Bury | 123/196 R |
| 4,406,784 | 9/1983 | Cochran | 123/196 A |
| 4,514,105 | 4/1985 | Adams et al. | 403/24 |
| 4,758,130 | 7/1988 | Waterworth | 123/196 R |
| 4,834,040 | 5/1989 | Yoshida | 123/198 C |
| 4,899,860 | 2/1990 | Diederich | 192/58 B |
| 5,006,237 | 4/1991 | Jones | 123/196 A |
| 5,203,441 | 4/1993 | Monette | 192/112 |
| 5,271,685 | 12/1993 | Stark | 403/171 |
| 5,281,878 | 1/1994 | Schaeffer | 417/423.6 |
| 5,291,969 | 3/1994 | Diederich, Jr. | 123/196 AB |
| 5,299,880 | 4/1994 | Bouchard | 403/3 |
| 5,407,294 | 4/1995 | Giannni | 403/337 |
| 5,558,058 | 9/1996 | Ming et al. | 123/196 A |

OTHER PUBLICATIONS

Milodon, Inc., 20716 Plummer St., Chatsworth, CA 91311—1996 Catalog, pp. 19, 21.

*Primary Examiner*—Erick R. Solis
*Attorney, Agent, or Firm*—Dan Williams

[57] ABSTRACT

An adaptor for mounting a high capacity external oil pump to an original equipment engine block having existing openings for mounting an external oil pump. The adaptor bolts on existing bolt holes in the engine block. Sump oil is routed through the adaptor into the high volume oil pump. The high volume gear pump is driven, through the adaptor, by the previously existing original equipment engine block mechanism and through the previously existing opening provided for driving the original equipment gear pump. The adaptor has openings for accepting dirty sump oil from the engine. Dirty sump oil is directed through a cavity to the intake side of the high capacity gear pump. An oil filter is provided on the gear pump cover. Orifices direct the pressurized oil from the gear pump to the filter. The filtered pressurized oil is returned to the engine by mating orifices in the adaptor, gear pump, and gear pump housing.

14 Claims, 6 Drawing Sheets

Fig. 2
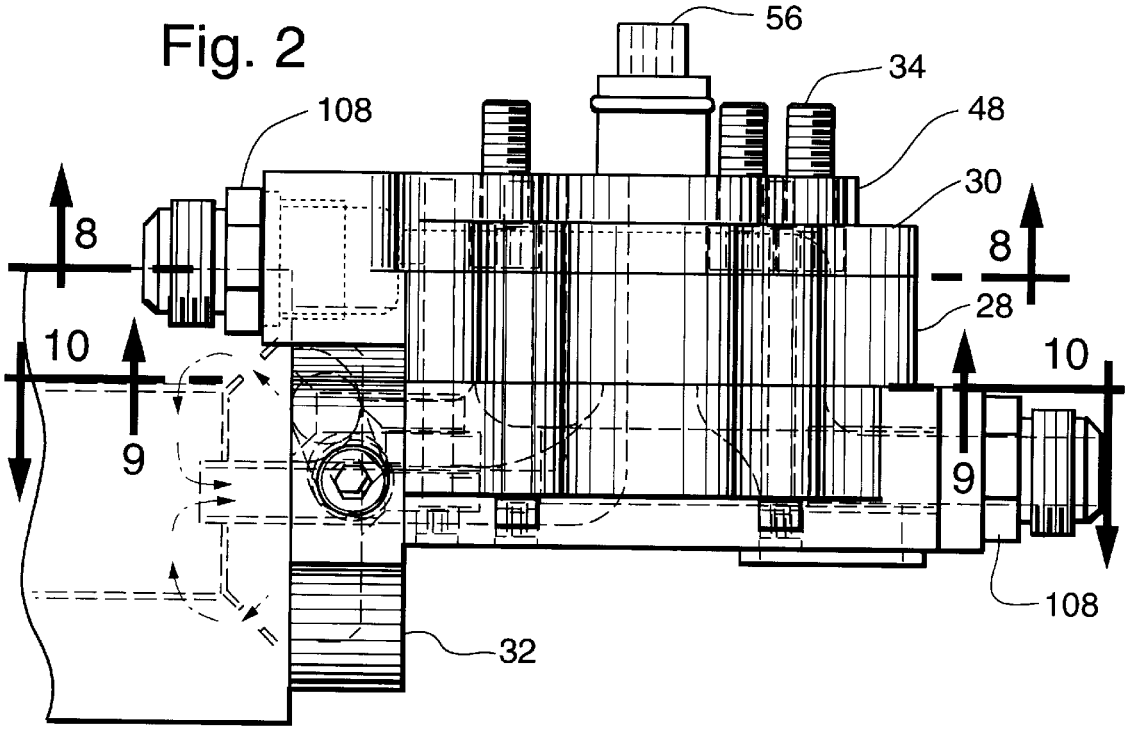
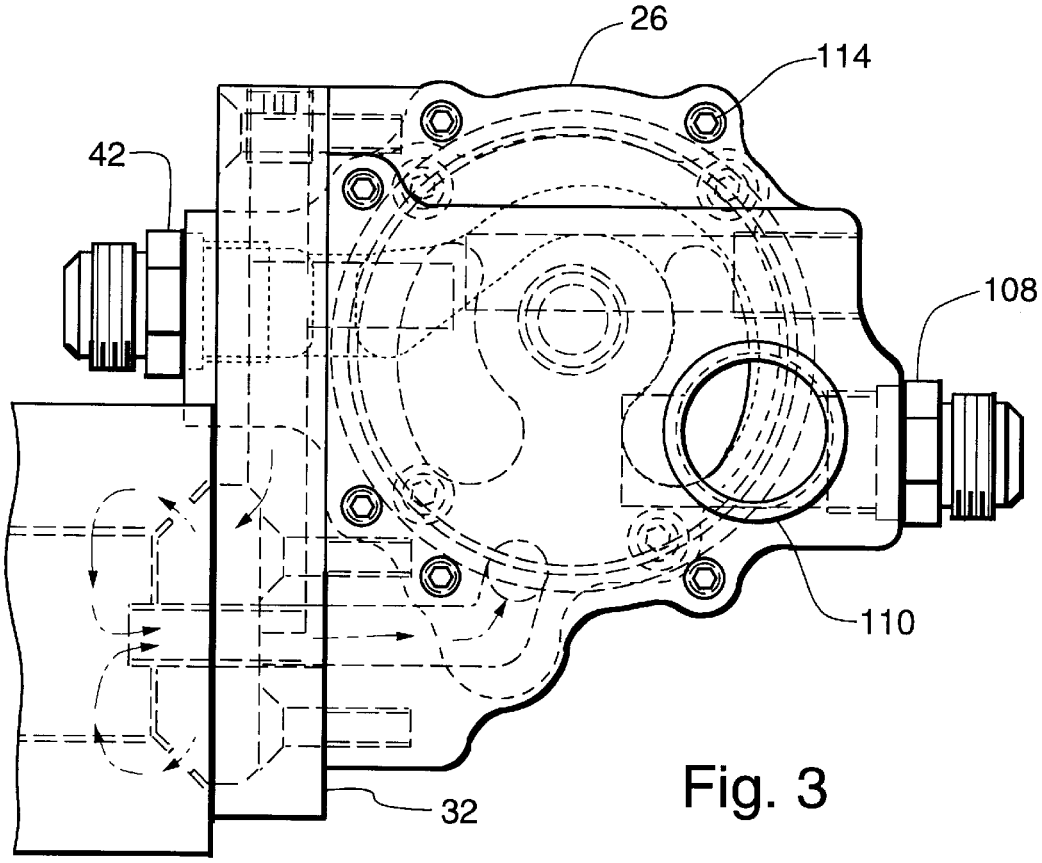
Fig. 3

OIL PUMP ADAPTOR

BACKGROUND

1. Field of the Invention

The present invention relates to adapters used to modify the mounting characteristics of externally mounted engine oil pumps. More particularly, the present invention relates to adapters used to allow the installation and operation of high volume oil pumps on engines designed for low volume external oil pumps.

2. Description of the Related Art

Automotive internal combustion engines have been designed with externally mounted oil pumps. Typical of this style engine is the Chrysler hemi engine that is made in capacities of 361, 383, 400, 413, 426 and 440 cubic inches. In this type of engine, oil passes from the engine sump to an externally mounted oil pump. After being pressurized and filtered in the oil pump assembly, the oil is returned to the engine block and routed by means of small passages to various points in the engine that require lubrication. The oil then finds its way via various passages back to the oil sump where it is again returned to the oil pump and filter for another cycle through the engine.

Production engine blocks are designed with street use in mind. Consequently, oil passages, pumps and filters have been designed and sized accordingly. However, some blocks originally designed for street use are modified for more racing use. In racing engines it is usually advantageous to maximize the torque and revolutions per minute (RPM) engine characteristics. Such increased demands on the engine make it desirable to increase the flow of lubrication oil to such an engine. Lubrication of engines with externally mounted oil pumps and filters has heretofore been limited by the size and capacity of the original engine orifices within the original engine bolt pattern designed to mount the pump and filter assembly.

It would be desirable to increase the oil flow capacity from that of pump/filter assembly of the original engine. What is needed is an adapter that can allow a larger capacity oil pump and filter to be externally installed in engines having an externally mounted oil pump. This product should be mounted on the original engine bolt hole pattern so as to require no modifications of the existing engine block. Moreover, the oil pump and filter should be positioned similar to the original pump and filter so as not to disturb the mounting locations of other engine hardware.

The adapter should also be configured to allow higher oil volumes to pass from the filter/pump mechanism to the engine. That is, passages should be generously sized and contoured so as to minimize restrictions to the oil flow.

Coryell, U.S. Pat. No. 4,121,532, shows a coupling used to join speedboat driveline components. Coupling bolts orifices are provided so that the coupling bolts are recessed into one face of the coupling thereby providing a flat surface for the secondary flange to nest against.

Monette, U.S. Pat. No. 5,203,441, shows an adaptor used to join a flywheel housing to a transmission clutch housing. One bolt circle is defined by the flywheel housing and the second bolt circle is defined by the bolt circle on the transmission clutch housing.

Although the prior art adaptors solved their specific problems of joining mechanical parts, the inventors were not required to address the problem of fluid flow within the adaptors. The oil pump adapter solves the additional problem of maximizing fluid flow through the adaptor.

SUMMARY OF THE INVENTION

One object of the present invention is to provide means for increased oil pumping and filtering capacity on a stock internal combustion engine having an externally mounted oil pump and filter.

Another object of the present invention is provide increased oil pumping and filtering capacity without the necessity of physically relocating other engine components.

Yet another object of the invention is to provide increased oil pumping and filtering capacity without modifying the existing stock engine block.

Still another object of the invention is to provide means by which a high capacity oil pump can be driven by the same internal engine mechanism used to drive the factory stock low capacity oil pump.

These and other objects are realized by providing an adaptor plate which can be fastened into the stud holes where the factory installed oil pump was originally installed. A larger capacity oil pump can be attached to the adaptor plate and yet still be driven by the original internal engine components. Filtering means can be located contiguous to the oil pump thus providing a compact oil pump/filter arrangement. Because of the compact design, internal passages can be provided within the adaptor plate and oil pump to provide direction to the oil flow and rout high pressure filtered oil back to the existing high pressure engine oil intake port.

An adaptor plate fastens to the engine block factory drilled and tapped holes in which the original factory designed oil pump and filter were installed. The adaptor plate receives and directs incoming oil flow from the engine sump to the oil pump. The plate has attachment points to which an oil pump is attached. These attachment points enclose a larger area than the engine attachment points to which the plate is attached. Integral in the plate are passages that direct high pressure filtered oil flow from the pump and filter to the original high pressure oil receiving ports on the engine block. The plate provides an aperture by which a gear shaft from the oil pump can be inserted into an existing receptacle in the engine block.

A gear pump is attached directly to the adaptor plate. The gear pump receives incoming unpressurized oil from the plate and increases the oil pressure. Because the adaptor plate increases the size of the enclosed area within the pump attachment points, the pump can be larger and more robust than original equipment oil pumps. Rotational power to the gear pump is provided by the mechanism already existing within the engine block; a shaft attached to the gear pump gear is inserted into the engine block to mate with the existing engine components originally used to rotate the original equipment oil pump.

A cover plate is provided on the gear pump to seal the gear pump, to provide alternative oil flow intakes into the oil pump, and to direct oil flow toward an oil filter. The cover plate has openings and passages that can accept oil from the sump. These openings and passages channel that oil to the low pressure side of the gear pump. High pressure oil output from the gear pump is directed through the cover plate's internal passages through a canister mounting block to an oil filter. Passages in the canister mounting block direct the filtered oil from the canister back through the cover plate, gear pump, and adaptor plate into the engine block.

BRIEF DESCRIPTION OF THE DRAWINGS

These and other features, aspects, and advantages of the present invention will become better understood with regard to the following description, appended claims, and accompanying drawings where:

FIG. 2 is a top plan view of the invention showing the adaptor/pump/filter assembly with the filter canister broken off;

FIG. 3 is a side elevation of the adaptor/pump/filter assembly of FIG. 2;

DETAILED DESCRIPTION

Although the disclosure herein is detailed and exact to enable those skilled in the art to practice the invention, the physical embodiments herein disclosed merely exemplify the invention which may be embodied in other specific structures. The scope of the invention is defined in the claims appended hereto.

The oil pump adaptor assembly consists essentially of an adaptor plate, a gear pump disposed between the adaptor plate and a cover plate, and an end plate on which a conventional oil filter canister is mounted.

Figure 1:
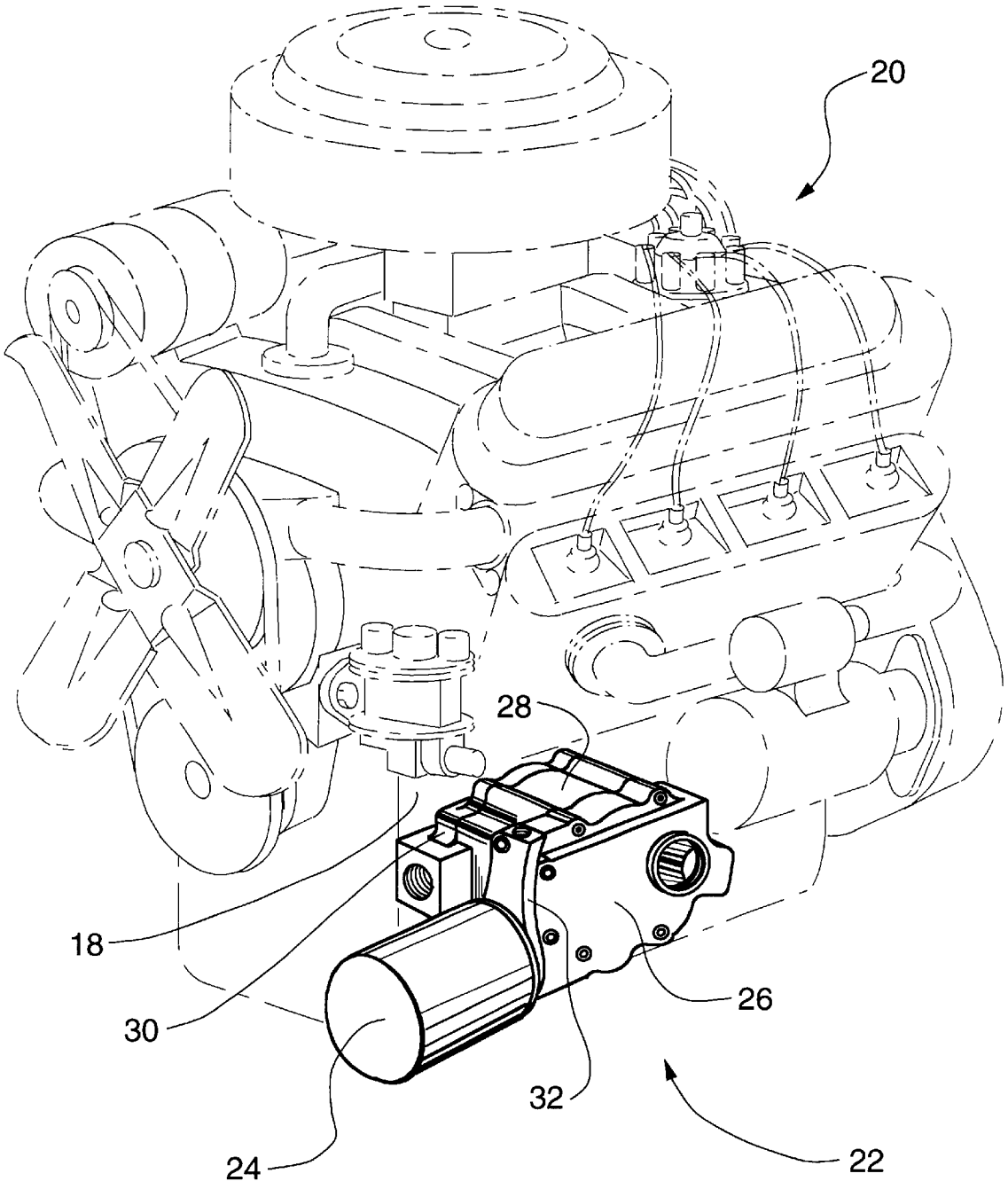
FIG. 1 is a schematic perspective view of a V-8 engine with the invention mounted in place on the engine block.
Figure 4:
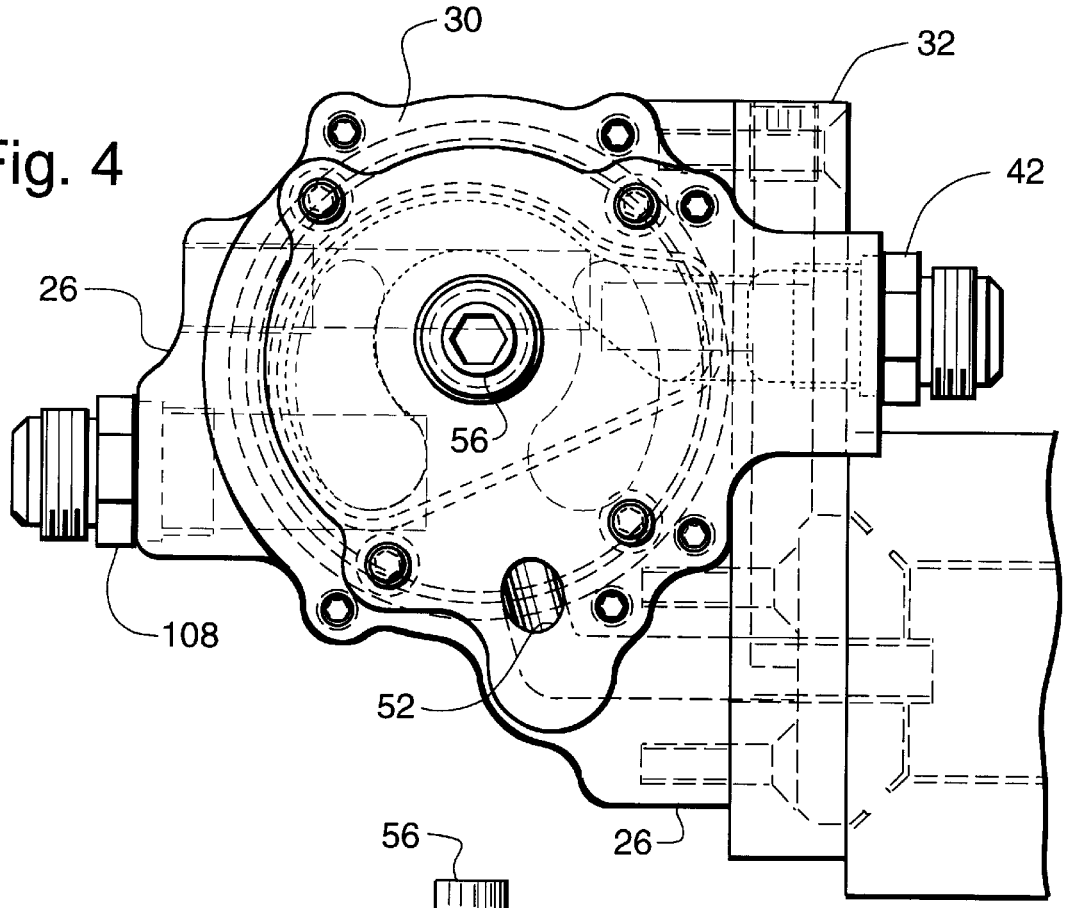
FIG. 4 is a side elevation of the adaptor/pump/filter assembly looking outwardly from the engine block.
Figure 5:
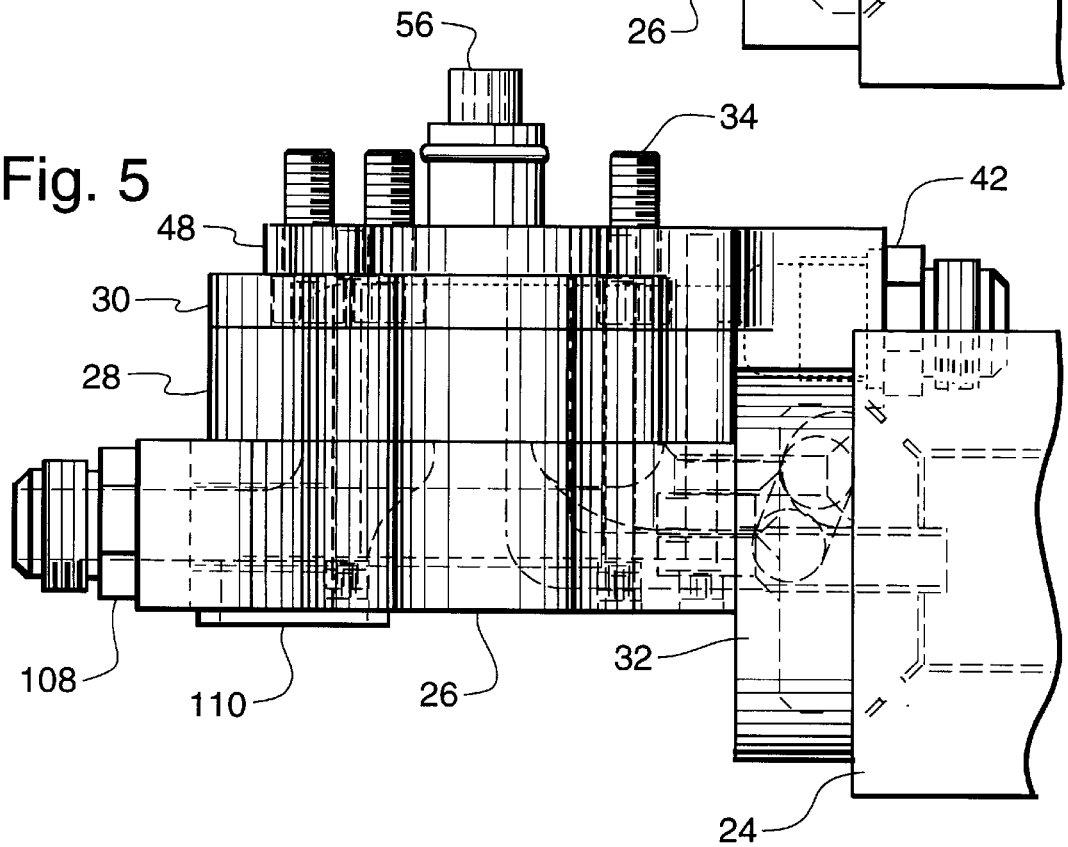
FIG. 5 is a bottom plan view of the adaptor/pump/filter assembly.
Figure 7:
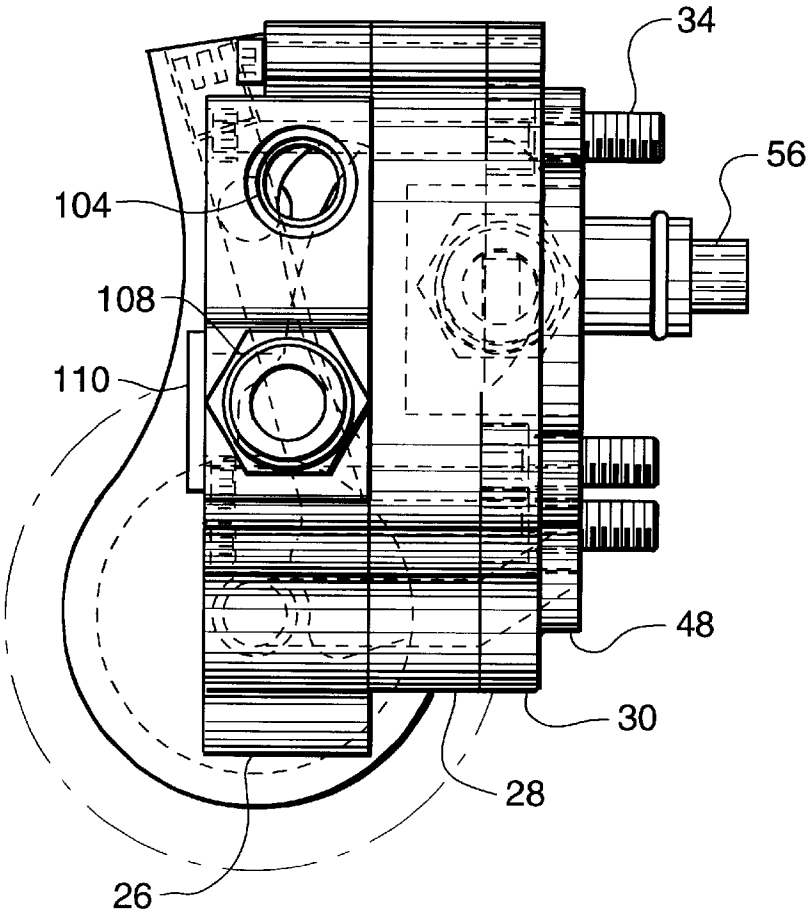
FIG. 7 is a rear end elevational view of the adaptor/pump/filter assembly as shown in FIG. 6.

The overall assembled layout of the assembly is best seen in FIG. 1 which shows a schematic perspective view of a V-8 engine with the oil pump assembly mounted thereon at the same location provided for in stock Chrysler hemi engines.

In order to facilitate clear understanding of the invention the features of each assembly component is discussed, ordered outwardly from the engine or in the order in which the components would be placed on the engine. Directional arrows have been provided on the drawings to show the direction of oil flow and further facilitate understanding of the invention.

Figure 8:
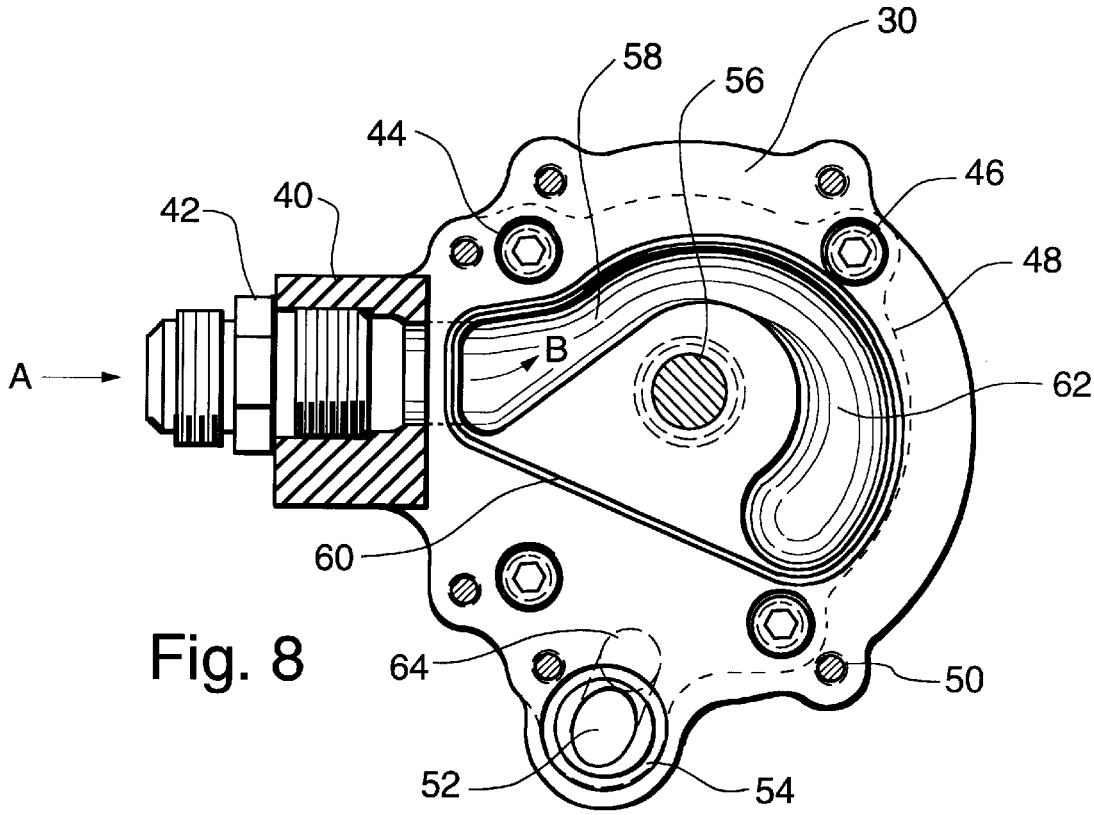
FIG. 8 is a sectional view through the adaptor/pump/filter assembly of FIG. 2 taken on line 8-8 of FIG. 2, between the adaptor plate and the gear pump housing looking toward the engine block.
Figure 9:
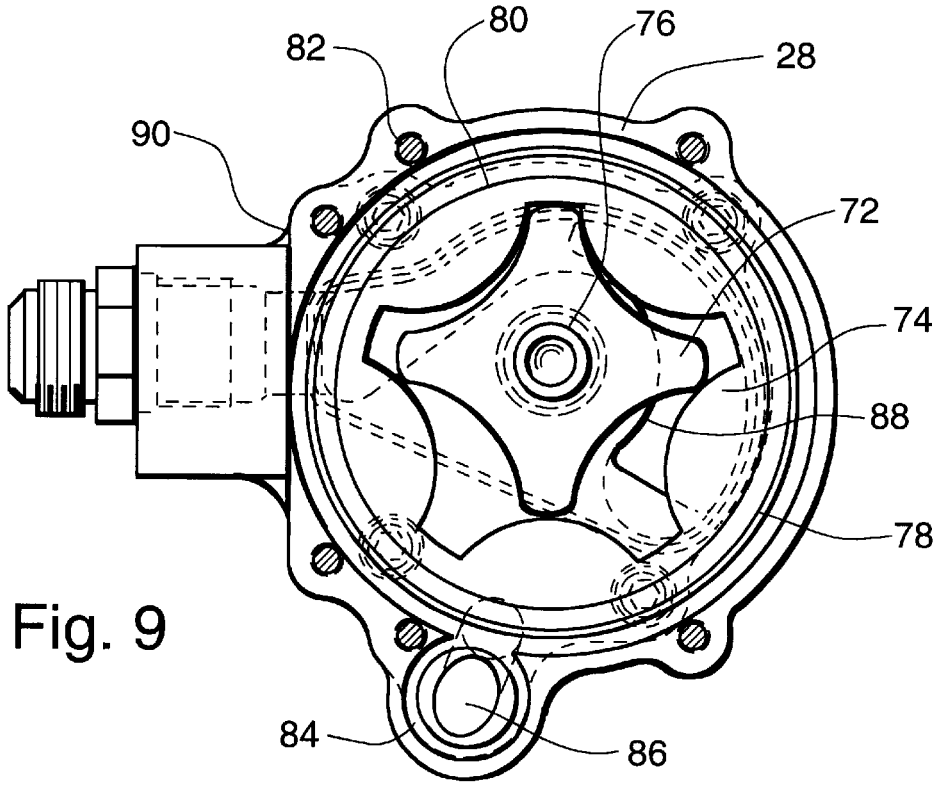
FIG. 9 is a sectional view taken through the assembly of FIG. 2 along the line 9—9 of FIG. 2, showing the gear pump housing in place against the adaptor plate.

Adaptor plate 30, best seen in FIG. 8 from the gear pump side, is mounted on engine 20 with screws 46. As depicted, screws 46 are typically cap screws which seat in cap screw recesses 44. The surface of the cap screw head seats slightly below plane 8—8, as shown in FIG. 2, so that plane 8—8 of plate 30 presents a flat surface with no protuberances other than adapter inlet 40. On the engine side of plate 30, screws 46 extend to threads 34 which match and are aligned with already existing stud holes (not shown) in the sidewall of engine block 18.

Adapter inlet 40, having an interior thread to receive inlet fitting 42, extends above plane 8—8. Inlet fitting 42 is depicted as a flare fitting however, a compression fitting or other type of fitting allowing a suction hose to be detachably connected to the fitting can be substituted. Inlet fitting 42 is connected to a suction hose (not shown) which receives oil from the engine sump. Inlet 40 is the primary inlet for oil into the adapter/pump/filter assembly.

The engine side of adaptor plate 30 presents a slightly different engine side contour 48 to the engine. A flat gasket, well known in the industry and not shown, is disposed between adaptor plate 30 and the engine so as to prevent oil leakage. The gasket, at a minimum, surrounds orifice 64 and shaft 56. Of course alternative sealing arrangements such as an o-ring may also be utilized.

As shown by a small arrow in FIG. 8, suction oil passes through inlet fitting 42 to inlet passage 58. Passage 58 is an elongated recessed cavity extending in depth partially through plate 30 that controls suction oil flow to sump area 62. Passage 58 is directed between gear shaft 56 and the holes through which screws 46 pass, terminating at the gear pump inlet sump area 62.

The area defined by passage 58, sump area 62 and gear shaft 56 are surrounded by groove 60 in which an O-ring (not shown) can be positioned to seal plane 8—8 of plate 30 against gear pump housing 28. Gear shaft 56 passes through adaptor plate 30 and when mounted on engine 20, extends into the engine and is rotated by components of the engine assembly. Rotation of shaft 56 causes gear 76 and gear ring 74 to rotate and operate as a gear pump.

Plate 30 also houses high pressure oil return passage 52. On Plane 8—8, passage 52 is sealed by an O-ring, not shown, seated in groove 54. Passage 52 passes through plate 30 and terminates at oil discharge orifice 64 on the engine side of plate 30. Orifice 64 mates with an opening on the engine block. From the opening on the engine block, high pressure oil is distributed through various passages to internal lubrication points in the engine.

Plate 30, for mounting purposes, includes threaded holes 50 into which cover plate screws 114 are threaded after component assembly is completed.

Gear pump housing 28 is best seen in FIGS. 2, 5, 7 and 9. The side of housing 28 contiguous to adaptor plate 30 is a flat surface broken only by pump sump orifice 88. O-rings in grooves 60 and 52 seal housing 28 against plate 30. Pump sump orifice 88 in housing 28 is positioned contiguous to gear pump inlet sump area 62 of plate 30 and allows inlet oil to pass from sump area 62 of adaptor plate 30 into pump housing 28. The peripheral exterior shape of pump housing 28 is similar to that adaptor plate 30 except that housing 28 extends in the direction of adaptor inlet 40 only to inlet flat surface 90 thus allowing inlet flat 90 to be positioned contiguous to inlet adaptor 40 of plate 30.

The side of housing 28 adjacent to cover plate 26 defines a circular cavity 80 into which gear ring 74 and gear 72 are placed. Gear 72 is rigidly and permanently affixed to gear shaft 56 which extends into the engine. Gear shaft stub 76 extends into cover plate 26 seating in shaft stub recess 112. Clearances must be sufficient to allow free rotation of gear 72 when shaft 56 is not locked in position by the internal engine block components.

Return passage 86 leads to adaptor oil return passage 52. O-rings seated in grooves 78 and 84 effectively seal housing 28 and its passages against cover plate 26.

Figure 10:
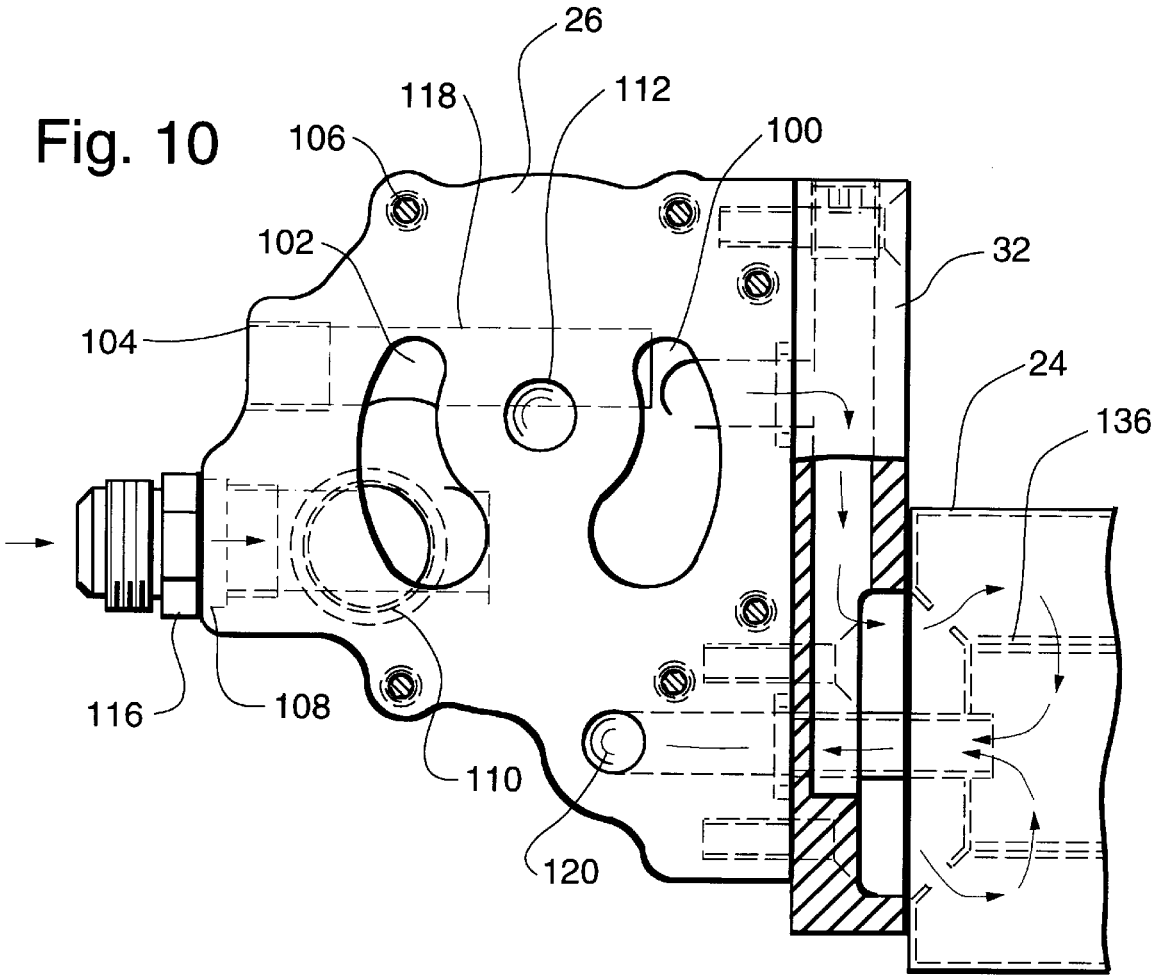
FIG. 10 is a sectional view through the assembly of FIG. 2 on the line 10—10 of FIG. 2 between the gear pump housing and the cover plate looking outwardly away from the engine block.

Referring now to FIG. 10 which depicts a view of the pump side of cover plate 26, pump discharge orifice 100 conducts high pressure oil from the gear and gear ring assembly though interior passages of cover plate 26 to end plate 32 and thence to filter canister 24. Inlet opening 102 is positionally aligned with pump sump orifice 88, meaning that it is aligned with the suction side of gear 72. Inlet opening 102 is interconnected by passages with secondary inlet 108 and tertiary inlet 110. The secondary and tertiary inlets are threaded so as to receive a flare or compression fitting, such as secondary inlet fitting 116 and thus may be connected other engine sump areas by suction hoses (not shown). If alterative suction areas in the engine sump are not present or not desired, inlets 108 and 110 may be closed off by means of a threaded plug (not shown).

Provisions for a safety valve on the high pressure oil pump discharge side of the pump have been made. As shown in FIG. 10, interior passage 118 connects orifice 102 to safety valve opening 104. A safety valve, well known in the industry, can fit within passage 118 and can be threaded into opening 104.

Cover plate mounting orifices 106 provide means for detachably mounting cover plate 26 to pump housing 28 and adaptor plate 30. Cover plate screws 114 freely pass through orifices 106 and mounting passages 82 before screwing into adapter plate 30. Screws 106 are shown as cap screws fitting into recesses on cover plate 26, however, this is not necessary. Any fastening means by which 26 can be detachably mounted to pump housing 28 and adaptor plate 30 is suitable.

Figure 6:
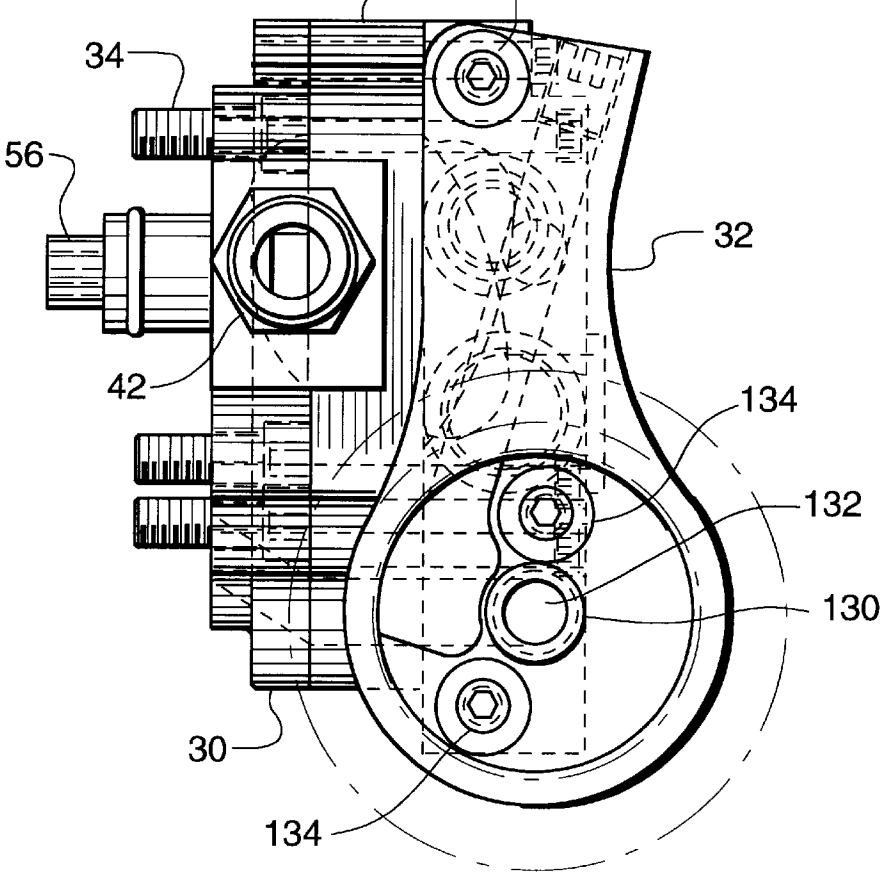
FIG. 6 is a front end elevational view of the adaptor/pump/filter assembly with the filter canister removed, but outlined in phantom lines

End plate 32 is secured to cover plate 26 with end plate mounting fasteners 134 as better seen in FIG. 6. Internal passages in end plate 32 conduct high pressure oil into oil filter canister 24 in which is mounted canister mounting stub 130. Stud 130 is hollow, containing canister discharge orifice 132, but threaded on its outside diameter thus allowing canister 24 to be threaded onto stub 130. High pressure filtered oil is introduced through filter canister 24 as seen in FIG. 10, passing through filter elements 136 to the central part of the canister.

High pressure filtered oil from canister 24 is conducted through an interior passage in cover plate 26 to filtered oil discharge orifice 120. When cover plate 26, pump housing 28, and adaptor plate are properly aligned, filtered oil discharge orifice 120 is aligned with pump return passage 86 and adaptor oil return passage 52 thus allowing high pressure filtered oil to flow to oil discharge orifice 64 from whence the high pressure filtered oil is introduced into the engine.

Many modifications and variations of the above invention are possible. In particular, mention is made of screws, bolts and other types of threaded fasteners. It is contemplated and within the scope of this invention that when such mention is made that other types of removable fasteners known to a person experienced in the art may be employed. Similarly, mention is made of O-rings and flat gaskets used for sealing purposes. Other methods of sealing mating surfaces are fully contemplated to be within the scope of this invention. More modern sealants may include viscous materials which are placed in a continuous bead in the area to be sealed and then squeezed in place by removable fasteners. It is therefore understood that the invention may be practiced otherwise than as specifically before described and still fall within the scope of the appended claims.

What is claimed is:

1. An adaptor for use with an engine having a bolt pattern by which an externally mounted oil pump can be removably attached to said engine, said engine having a port by which filtered high pressure oil is introduced into said engine, a sump by which dirty engine oil is removed from said engine, and a hole by which a gear pump drive shaft may be inserted in said engine, said adaptor comprising:

(a) a plate having a first surfaces a second surface, and a side wall, said surfaces being flat and spaced apart with said side wall forming the peripheral boundary of said surfaces;

(b) a plurality of first apertures disposed within said plate in a pattern aligned with and complementary to said bolt pattern of said engine, said first apertures being perpendicular to said first surface;

(c) a plurality of second apertures in said plate, the second apertures describing a peripheral shape larger than that described by the first apertures;

(d) a through passage in said plate, said passage disposed perpendicular to said first surface and aligned with said gear pump drive shaft hole;

(e) an orifice through which dirty engine oil is introduced to said adaptor from said sump, said orifice positioned on and passing through said side wall;

(f) a cavity in said second surface, said cavity being joined to said orifice to form a channel through which oil may flow, said cavity being spaced apart from said first surface and disposed in a semi-circular pattern about said passage;and (g) an opening through which said filtered high pressure oil is introduced into said engine through said port.

2. The adaptor of claim 1 having a gear, said gear being fixedly attached to a drive shaft, said shaft being insertable through said passage into said hole of said engine block.

3. The adaptor of claim 1 wherein said first surface and said second surface are parallel.

4. An assembly, removably attachable to an engine having a bolt pattern by which an externally mounted oil pump can be removably attached to said engine, said engine having a port by which filtered high pressure oil is introduced into said engine, a sump by which dirty engine oil is removed from said engine, and an hole by which a gear pump drive shaft may be inserted in said engine, said assembly comprising:

(a) an adaptor plate having a first surfaces, a second surface and a sidewall, said surfaces being spaced apart, said adaptor plate further having a plurality of first apertures in a pattern aligned with said bolt pattern, and a plurality of second apertures, said second apertures describing a peripheral shape pattern larger that that described by the pattern of the first apertures, said apertures being perpendicular to said first surface, said adaptor also having an orifice disposed through said sidewall through which dirty engine oil is introduced to said adaptor, a passage disposed perpendicular to said first surface and aligned with said gear pump drive shaft hole, a cavity in said second surface, said cavity being spaced apart from said first surface and disposed in a semi-circular pattern about said passage and joining said orifice to form a channel through which oil may flow, and an opening through which said filtered high pressure oil is introduced into said engine port;

(b) a gear pump having a cover, said gear pump having an external drive shaft positioned within said passage and extending into said engine drive shaft hole and being detachably mounted contiguous to the second adaptor surface through said second apertures;

(c) a filter removably attached to said gear pump; and (d) means for directing the high pressure oil flow from said gear pump to said filter and returning said filtered oil to said adaptor.

5. The assembly of claim 4 in which said gear pump has a removably detachable cover plate, said cover plate having an opening through which dirty engine oil may be introduced to said gear pump, means for transporting high pressure oil to said filter, and means for returning said filtered high pressure oil to said adaptor.

6. The assembly of claim 5 further comprising an end plate on which said filter is removeably mounted, said end plate being removeably fixed to said cover plate and having internal passages directing the flow of said filtered high pressure oil to said adaptor and means for directing high pressure oil to said filter.

7. The assembly of claim 6 in which said end plate has means to direct filtered high pressure oil to said cover plate and said cover plate has means to direct said filtered high pressure oil to said adaptor.

8. The assembly of claim 7 in which said cover plate has an opening through which dirty engine oil may be introduced to said gear pump.

9. An assembly for mounting a high capacity oil pump in place of a standard oil pump on an engine designed with an oil pump external to the engine block, the engine having a port through which high pressure filtered oil may be introduced, a hole in which rotating gear pump drive is accessed, and a plurality of threaded holes arranged in a pattern around said port and said hole; the engine also having a one or more sump openings at which dirty engine oil is collected, the assembly comprising:

(a) an adaptor plate having a periphery, a first surface and a second surface spaced apart and being substantially parallel, said adaptor plate being removably attached to said engine block through a plurality of apertures matching said threaded hole pattern in said engine block, said first surface of said plate being positioned contiguous to said block;

(b) an axial opening in said adaptor plate perpendicular to said first surface, said opening positionally aligned with said gear pump drive hole in said engine block;

(c) a bore in said adaptor plate extending from said first surface to said second surface and aligned with said port on said engine block;

(d) a cavity in said adaptor plate, said cavity having a first end and a second end, the first end opening into the second surface of said adaptor plate, the second end terminating on the periphery of said adaptor plate;

(e) means to direct the flow of dirty engine oil from said sump to said second end of said cavity.

(f) a gear pump housing removably attached to said second surface of said adaptor plate, said housing having a suction opening allowing oil to enter from the second end of said cavity and further having an aperture in alignment with said gear pump drive hole in said engine;

(g) a gear pump having a shaft mounted gear disposed within said pump housing, the shaft passing through said aperture of said pump housing, further passing through said opening in said adaptor plate and entering said gear pump drive hole in said engine.

10. The assembly of claim 9 further comprising a plurality of connective apertures in said plate, the connective apertures describing a peripheral shape larger than that described by the threaded hole pattern around said port.

11. The assembly of claim 10 further comprising a plurality of connective apertures having a pattern in said pump housing, the pattern of said apertures matching the pattern of the connective apertures in said plate.

12. The assembly of claim 11 having a cover plate affixed to said pump housing through the connective apertures of said pump housing and the connective apertures of said plate.

13. The assembly of claim 12 in which said gear pump housing provides means to direct high pressure oil from said cover plate to said adaptor plate.

14. The assembly of claim 13 further comprising an oil filter detachably mounted to said cover plate.

* * * * *